US007752830B2

(12) United States Patent
Goldwater et al.

(10) Patent No.: US 7,752,830 B2
(45) Date of Patent: Jul. 13, 2010

(54) ELECTRONIC ELONGATION-SENSING ROPE

(75) Inventors: Dan Goldwater, Emeryville, CA (US); Saul Griffith, Emeryville, CA (US); Eric Wilhelm, Oakland, CA (US); Colin Bulthaup, Oakland, CA (US)

(73) Assignee: Makani Power, Inc., Alameda, CA (US)

( * ) Notice: Subject to any disclaimer, the term of this patent is extended or adjusted under 35 U.S.C. 154(b) by 0 days.

(21) Appl. No.: 12/380,310

(22) Filed: Feb. 25, 2009

(65) Prior Publication Data

US 2009/0160426 A1 Jun. 25, 2009

Related U.S. Application Data

(63) Continuation of application No. 11/074,292, filed on Mar. 7, 2005, now Pat. No. 7,516,605.

(60) Provisional application No. 60/521,200, filed on Mar. 10, 2004.

(51) Int. Cl.
*D02G 3/02* (2006.01)

(52) U.S. Cl. ..... 57/238

(58) Field of Classification Search ..... 57/236, 57/238, 244, 264, 265
See application file for complete search history.

(56) References Cited

U.S. PATENT DOCUMENTS

| | | | | |
|---|---|---|---|---|
| 5,182,779 | A * | 1/1993 | D'Agostino et al. | 385/13 |
| 5,834,942 | A * | 11/1998 | De Angelis | 324/522 |
| 6,276,215 | B1 * | 8/2001 | Berg | 73/800 |
| 6,361,299 | B1 * | 3/2002 | Quigley et al. | 428/35.9 |
| 7,117,981 | B2 * | 10/2006 | Logan et al. | 187/391 |
| 7,123,030 | B2 * | 10/2006 | Robar et al. | 324/693 |

* cited by examiner

*Primary Examiner*—Shaun R Hurley
(74) *Attorney, Agent, or Firm*—Van Pelt, Yi & James LLP

(57) ABSTRACT

A fibrous tension member includes a plurality of structural threads and two or more indicator threads. The two or more indicator threads are located with respect to the plurality of structural threads such that a differential elongation between the two or more indicator threads indicates a curvature. The differential elongation between the two or more indicator threads is measured using a change in one or more electrical properties of each of the two or more indicator threads as each of the two or more indicator threads changes in length. A fibrous tension member includes a plurality of structural threads and one or more indicator threads. Each of the one or more indicator threads is more sensitive to elongation in a region of length of the fibrous tension member. The elongation of the region associated with one of the one or more indicator threads is measured using a change in one or more electrical properties of one of the one or more indicator threads as one of the one or more indicator threads changes in length.

14 Claims, 20 Drawing Sheets

ELECTRONIC ELONGATION-SENSING ROPE

CROSS REFERENCE TO OTHER APPLICATIONS

This application is a continuation of U.S. patent application Ser. No. 11/074,292, entitled ELECTRONIC ELONGATION-SENSING ROPE filed Mar. 7, 2005 now U.S. Pat. No. 7,516,605 which is incorporated herein by reference for all purposes, claims priority to U.S. Provisional Patent Application No. 60/521,200, entitled ELECTRONIC ROPES, filed Mar. 10, 2004 which is incorporated herein by reference for all purposes.

FIELD OF THE INVENTION

The present invention relates to systems and methods for measuring elongation or curvature experienced globally or locally by an elongate fibrous tension member.

BACKGROUND OF THE INVENTION

Almost any type of material which can be twisted, pulled, extruded, spun, stretched, or otherwise fabricated into a filament or fiber can be used to make ropes. Basically, a rope is an elongate structural element which is fabricated from any collection of elongated members, such as filaments or fibers, which are manufactured into some type of a long, structural line which is relatively flexible and capable of carrying tensile loads.

Herein, the term "rope" refers to rope, cord, wire rope, cable, and the like.

Herein, the term "webbing" refers to fibrous tension members which are substantially flat and comprised of fibers woven, bundled, knit, braided, felted, or twisted together. Webbing includes strong, narrow, closely woven fabric used especially for seat belts and harnesses or in upholstery.

Herein, the term "fibrous tension member" refers to rope or webbing comprising multiple threads woven, bundled, knit, braided, felted, or twisted-together such that the resultant member is at least somewhat flexible.

Elongation, stress, and strain are generally related to each other. For example, if a rope supporting a load elongates one inch and is operating in its elastic range, the strain is also one inch and the stress may be deduced by knowing the length of rope being loaded, its spring constant, and knowing whether elongation is increasing or decreasing (hysteresis). If one tracks elongation over time, one knows which hysteresis curve should be used to relate elongation to stress. Also, if one tracks elongation over time, one can distinguish non-recoverable plastic deformation (yield) from elastic strain. For these reasons, for the purposes of this application in both the specification and the claims, the term "elongation" refers to elongation, stress, or strain.

Most common ropes are manufactured by the following process:

1. Relatively short to moderately long filaments or fibers are twisted into yarns.

2. Yarns are twisted into cords.

3. Cords are twisted into strands. This process is called "forming." Sometimes, extra cords, yarns, and/or filaments (made from relatively flexible materials) are added during the forming process for internal lubrication in each strand. These extra cords, yarns, and/or filaments are commonly used during the fabrication of ropes that are subjected to relatively high flexural loads.

4. Two or more strands are twisted into a rope. This process is called "laying." Similar to Step 3, extra strands, cords, yarns, and/or filaments (made from relatively flexible materials) can be added during the laying process to improve internal lubrication in the rope.

5. Two or more ropes are twisted into a wire rope or cable. Similar to Step 4, extra elongated members can be added to improve internal lubrication in the cable.

Ropes may alternatively be manufactured using bundling, weaving, and/or felting techniques. Many ropes have external materials applied to the yarns, cords, or strands to improve environmental resistance, as well as handling characteristics. Application processes for these materials include galvanizing, bonding, painting, and coating.

Ropes and webbing are integral to a wide range of activities. The potential cost in equipment damage, personnel injuries and even lives of failing or overloaded ropes is high. The fiscal cost of maintaining and inspecting ropes and webbing is high. Safety factors in ropes and webbing are significant, on order five to fifteen times expected load, with inherent weight cost.

An external load sensing element such as a load cell can be used to measure stress on a rope. This provides stress measurement at a point such as a pulley connection or the interface between the rope and a load. However, sometimes the elongation varies along the rope which would not be discernable with a point measurement such as that provided by a load cell. In addition, some applications such as rock climbing, would not easily allow the permanent connection of a load cell to a rope so the rope may be used when it is not monitored, allowing damage to occur without monitoring.

Various means have been proposed for providing an indication of damage to ropes and webs. In U.S. Pat. No. 5,834,942 to Pethrick et al., a synthetic fiber cable is disclosed which includes one or more electrically conductive indicator threads placed into the strands to monitor the state of the cable. A tearing of the fiber may be detected by applying a voltage to the indicator thread. In this manner, each individual strand of a synthetic fiber cable can be checked and the cable can be replaced when a predetermined number of torn strands have been exceeded.

In the case of the above-mentioned patent, the indicator threads and sensing unit are capable of detecting when a threshold voltage limit value is exceeded by torn indicator threads. The Pethrick system particularly shows a threshold value switch SW to binarize the output and their discussion speaks only of setting this threshold value to that which would indicate breakage of the indicator thread.

In the case of the above-mentioned patent, the indicator threads connect to the sensing unit via connecting elements—physical contacts at the end of the cable. This limits the application to cases where the end of the cable is accessible to the sensing unit and the data produced refers to the cable's entire length as there is no provision for sensing a portion of the cable.

Various means have been proposed for providing a measure of strains and kinks in ropes. In U.S. Pat. No. 5,182,779 to D'Agostino et al., a rope is disclosed which includes one or more optical fibers placed into the strands to monitor the state of the rope. Such a system is capable of measuring strain in the rope by means of detecting Rayleigh reflections due to density fluctuations. Such a system can detect macrobends and microbends which change the angle at which light strikes the interface between core and clad, causing light to be absorbed into the clad or reflected back to the source. Such a system can use optical time domain reflectometry (OTDR) to detect and locate breaks resulting in Fresnel reflections. Such a system can use preformed optical fiber to minimize residual stresses in the indicator fiber resulting from twisting in the rope manufacturing process. Preforming is the process of twisting an elongated member, such as a filament in the opposite direction as the twisting process to make a rope so the indicator thread is relatively untwisted in the final rope. Such a system can use prestressed rope to allow the rope to strain past the breaking point of the optical indicator fiber.

Such a system requires a sophisticated optical sensing-processing unit. Accordingly, there is a need in the art for an improved system and method for measuring elongation or curvature experienced globally or locally by fibrous tension members.

SUMMARY OF THE INVENTION

The present invention provides a fibrous tension member such as rope or webbing having means for electrical sensing of elongation which solves at least some of the above-noted problems. The applicants have developed and tested prototypes of a new class of multi-functional rope structure where the incorporation of metallic or conducting fibers in the proper configurations and fiber placements (known as rope constructions) leads to ropes and cables that can electronically sense their loading condition and/or continuously record their loading history. In accordance with one aspect of the present invention, a fibrous tension member comprises, in combination, at least one indicator thread. The indicator thread comprises discrete segments of conductive fibers. The indicator thread also comprises means for electrical sensing of elongation of the fibrous tension member.

According to another aspect of the present invention, a method for sensing elongation of a tension member comprising the steps of, in combination, providing a fibrous tension member with at least one indicator thread and providing the indicator threads with discrete segments of conductive fibers. A sensing-processing device is electrically connected to the indicator thread to determine the elongation of the tension member.

From the foregoing disclosure and the following more detailed description of various preferred embodiments it will be apparent to those skilled in the art that the present invention provides a significant advance in the technology and art of electronic elongation-sensing rope. Particularly significant in this regard is the potential the invention affords for providing a high quality, durable, reliable, versatile, and relatively inexpensive system. Additional features and advantages of various preferred embodiments will be better understood in view of the detailed description provided below.

BRIEF DESCRIPTION OF THE DRAWINGS

Various embodiments of the invention are disclosed in the following detailed description and the accompanying drawings.

Figure 1:
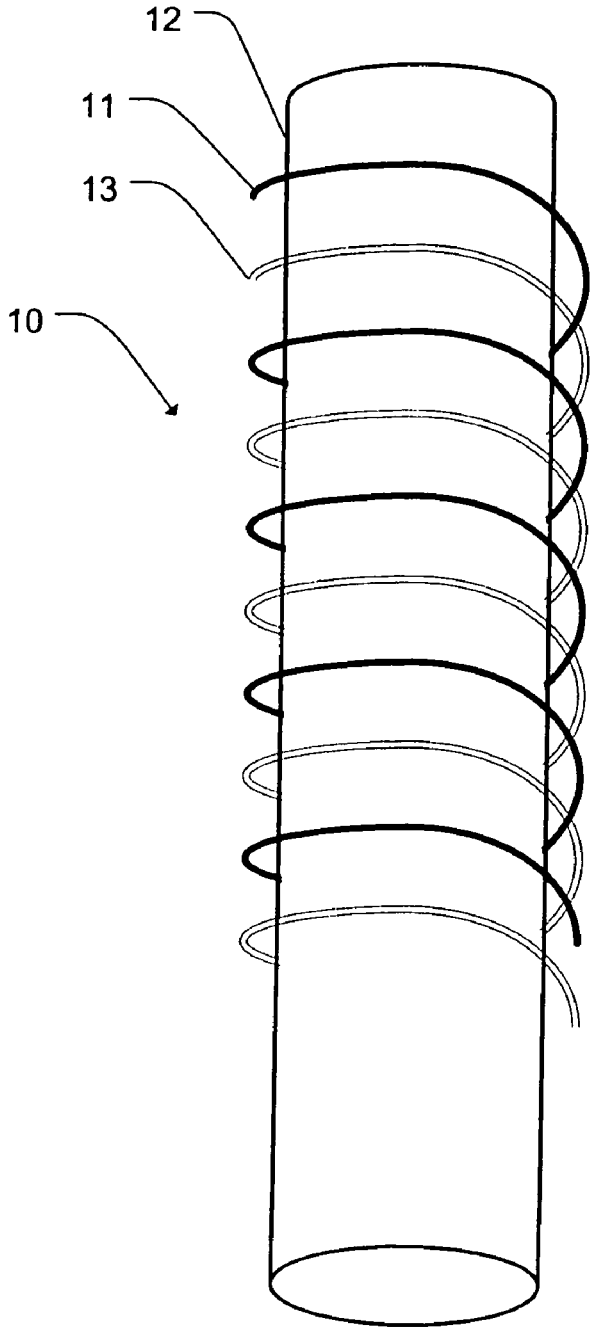
FIG. 1 shows an indicator thread comprising a "whipped" (i.e. helically-wrapped) bare conductive fiber interleaved with whipped non-conductive fiber.

It should be understood that the appended drawings are not necessarily to scale, presenting a somewhat simplified representation of various preferred features illustrative of the basic principles of the invention. The specific design features of fibrous tension members as disclosed herein, including, for example, specific dimensions, orientations, and shapes will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the fibrous tension members illustrated in the drawings.

The following reference numbers are used in the specification and drawings:

1 10 indicator bundle 11 indicator thread 12 core 13 non-conductive thread 20 indicator bundle 21 helically-wrapped indicator thread 22 core 23 test equipment 30 whipped indicator thread 31 inductive pickup 32 test equipment 40 rope-end jumper 41 rope-end terminal 50 coax indicator bundle 51 core conductor 52 insulator 53 sheathe conductor 54 test equipment for coax 60 rope 61 structural thread 62 indicator thread 63 discrete conductive fiber 64 discrete non-conductive fiber 65 rope sheathe 66 test equipment 67 test equipment lead 70 indicator thread 71 discrete conductive fiber 72 continuous non-conductive fiber 80 indicator thread with high resistance per unit length 81 indicator thread with low resistance per unit length 82 rope with changing resistance indicator thread 90 coax with changing capacitance 91 region of low capacitance per unit length 92 region of high capacitance per unit length 93 dielectric 94 core 100 whipped indicator bundle with changing inductance 101 indicator thread 102 region of low inductance per unit length 103 region of high inductance per unit length 104 core 110 rope with three indicator cable to localize elongation 111 test equipment to localize elongation 113 region of low conductivity for thread 116 114 region of low conductivity for thread 117 115 region of low conductivity for thread 118 116 indicator thread with one region of low conductivity 117 indicator thread with one region of low conductivity 118 indicator thread with one region of low conductivity 120 rope being winched onto a spool 121 load suspended by a rope 122 spool 123 test equipment connecting to adjacent tap points 124 tap points on rope 130 indicator thread on outside of the kink 131 indicator thread on inside of the kink 132 test equipment to measure differential elongation 140 rope with tap points along 141 indicator fiber in core of rope 142 tap point 150 indicator bundle 151 whipped sections of indicator thread 152 straight sections of indicator thread 153 inductively-coupling test equipment 160 rope with three indicator threads 161 indicator thread traveling in rope core 162 tap point where indicator thread emerges from core 170 sensing device to measure between adjacent tap points 180 ring connector 181 connector terminal 182 test equipment for connecting to multiple tap points around rope 190 jumper 191 tap points 192 test equipment 193 indicator threads 194 rope 200 indicator thread 201 wireless transmitting sensor-processor 202 wireless data receiver 203 rope with embedded wireless test equipment.

DETAILED DESCRIPTION OF CERTAIN PREFERRED EMBODIMENTS

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

It will be apparent to those skilled in the art, that is, to those who have knowledge or experience in this area of technology, that many uses and design variations are possible for the fibrous tension members disclosed herein. The following detailed discussion of various alternative and preferred embodiments will illustrate the general principles of the invention with reference to specific embodiments. Other embodiments suitable for other applications will be apparent to those skilled in the art given the benefit of this disclosure.

Discrete Segments

Figure 6:
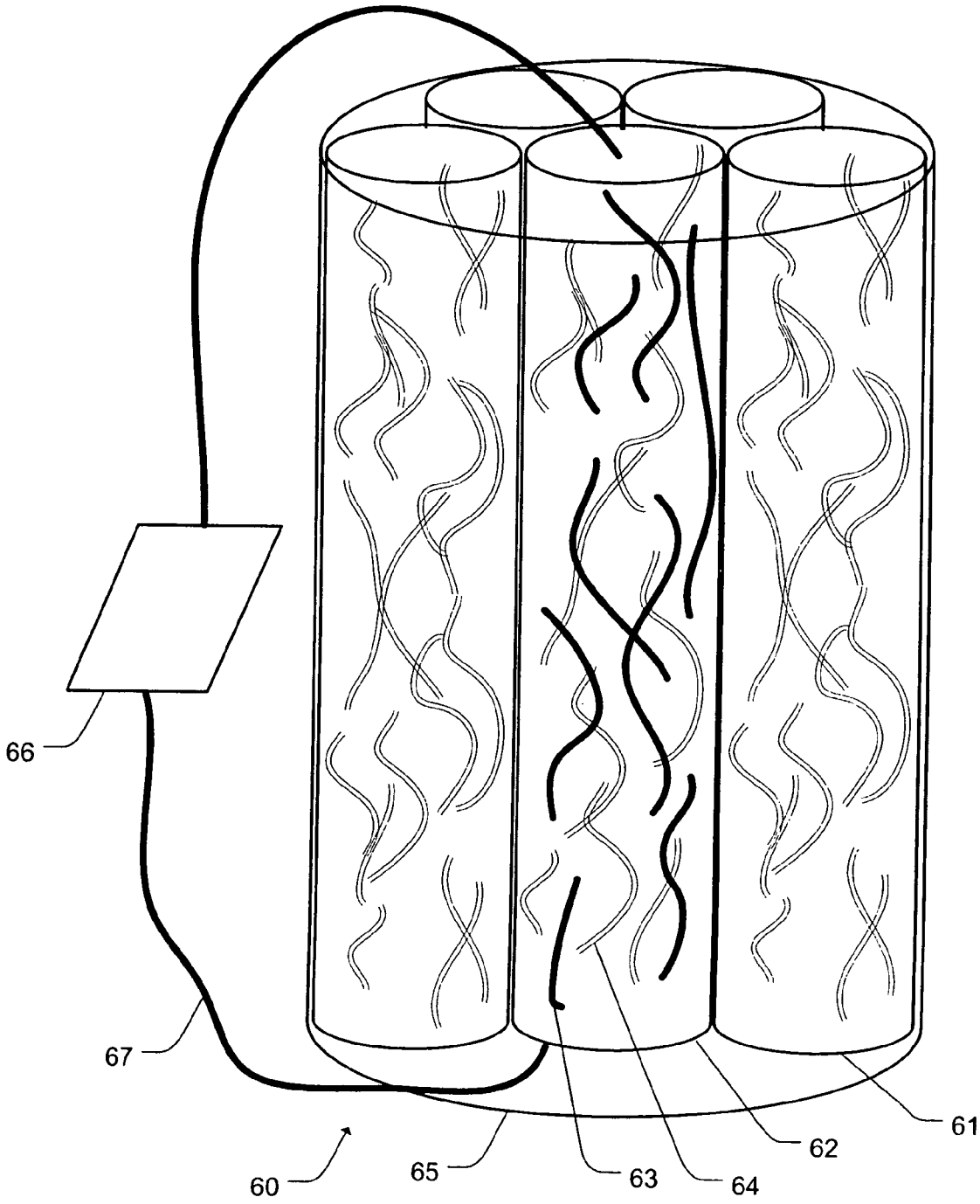
FIG. 6 shows an indicator thread comprising discrete conductive and discrete non-conductive fibers.

A preferred embodiment of the present invention is illustrated in FIG. 6. In this system, the fibrous tension member is a rope 60. The rope 60 consists of a sheathe 65 encapsulating seven threads consisting of six structural threads 61 and one indicator thread 62. The front two structural threads 61 are removed in the drawing to show the indicator thread 62 in the core of the rope 60. The electrical indicator thread 62 consists of 80% by weight non-conductive polyester fibers 64 chosen for their structural strength and 20% by weight discrete segments of conductive stainless steel fibers 63. The length and diameter of the conductive fibers 63 affects the electrical characteristics of the indicator thread. We have found that conductive fibers with diameters 5-10 um and lengths 5-50 mm have provided good response. As a tensile load is applied axially to the rope 60, the conductive 63 and non-conductive 64 fibers are compressed transaxially, increasing the surface contact of adjacent conductive fibers 63 and decreasing the overall resistance of the indicator thread 62. As the tension is further increased, the conductive fibers 63 are stretched, reducing their cross-section and increasing their resistance. The resistivity of the indicator thread 62 is modulated by these effects, and that modulation can be tailored by the choice of the construction method of the rope 60 by, for example, controlling the proportion of conductive fibers 63, properties of the non-conductive fibers 64 and how conductive fibers 63 are mixed in, the length, diameter, or composition of conductive fibers 63, and the placement of indicator thread 62 in the rope 60.

Figure 7:
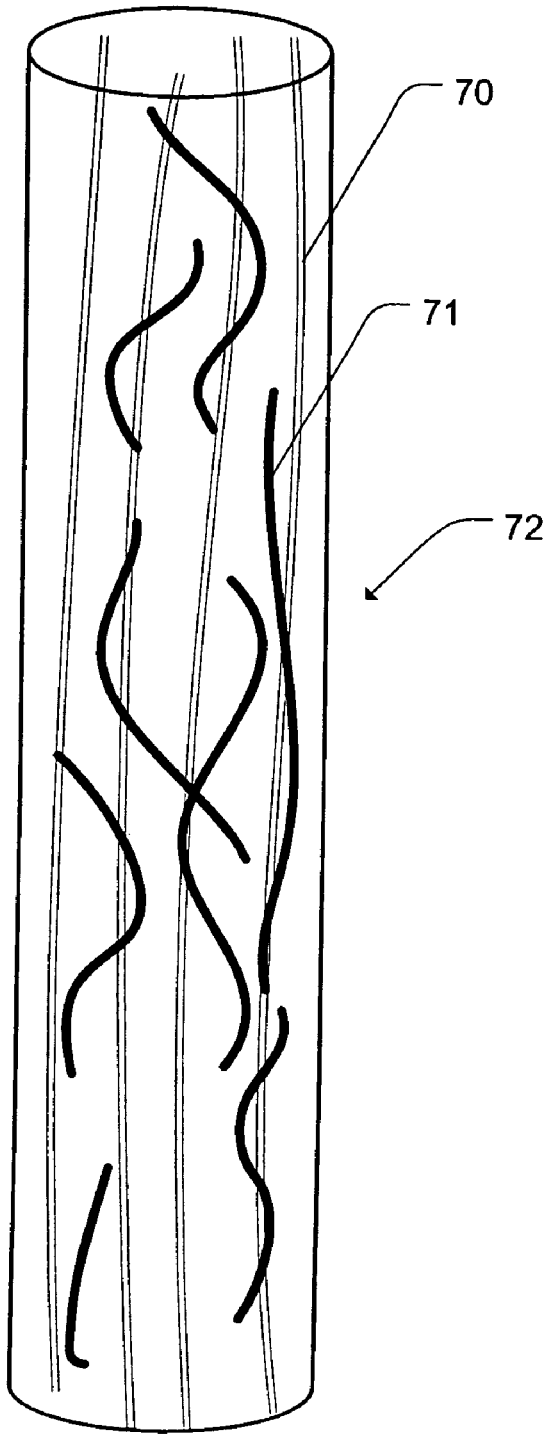
FIG. 7 shows an indicator thread comprising discrete conductive and continuous non-conductive fibers.

As shown in FIG. 7, the indicator thread 72 may consist of continuous non-conductive fibers 70 instead of discrete. The conductive fibers 71 remain discrete to reduce sensitivity of system to strain-induced conductive fiber 71 breakage.

Fibrous tension members are commonly made from a hierarchy of threads. Larger threads are composed of smaller threads, larger strands are composed of smaller strands. The preferred embodiment of the invention may include hierarchical composition of the fibrous tension member, and may include hierarchical composition of the indicator thread.

Loop to Make Circuit

Figure 4:
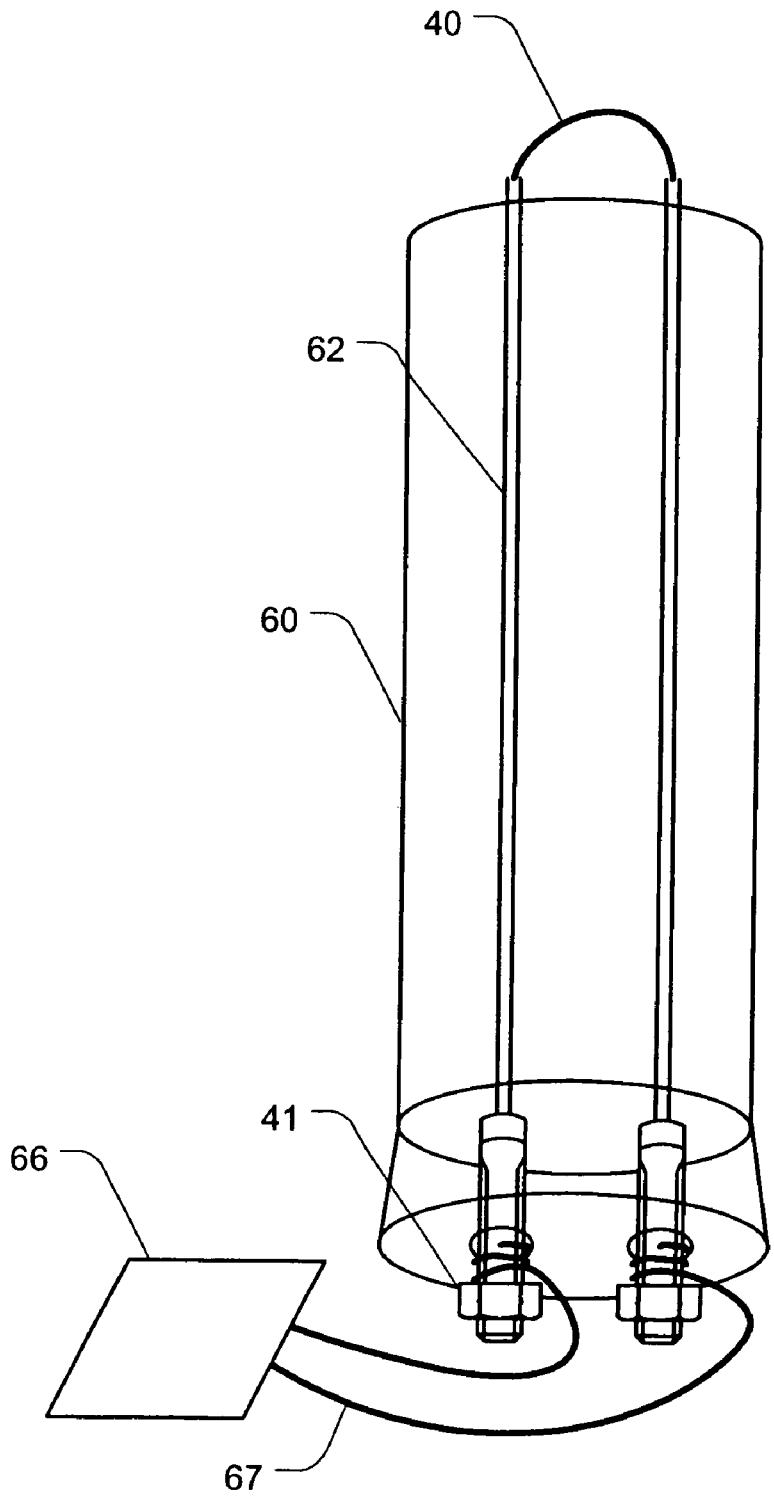
FIG. 4 shows a rope with a pair of electrically resistive indicator fibers connected to each other at one end of the rope, allowing sensing from the other end of the rope where a connector allowing direct connection to an external sensor is mounted.

In order to measure the resistance of an indicator thread, it must form a complete circuit with the test equipment. As shown in FIG. 6, the test equipment 66 may be connected via test equipment leads 67 to the indicator thread 62 at each end of the rope 60. Alternatively, as shown in FIG. 4, two indicator threads 62 pass through the rope 60 and are attached via a rope-end jumper 40 at one end and rope end terminals 41 connected to the test equipment 66 to form a closed circuit with regard to the test equipment 66. Alternatively, a single conductive fiber can be run through the rope and serve as the 'ground' for all other indicator threads. At the end of the rope all indicator threads are connected to the ground wire. This ground conductor may be made with a lower resistance than the indicator threads so it does not much influence the resistivity of the indicator thread measurements. The system may be configured so that the test equipment 66 provides enough power to the indicator thread 62 to warm it. This may be used to maintain pliability of the fibrous tension member in cold weather.

Kink Detection

Figure 13:
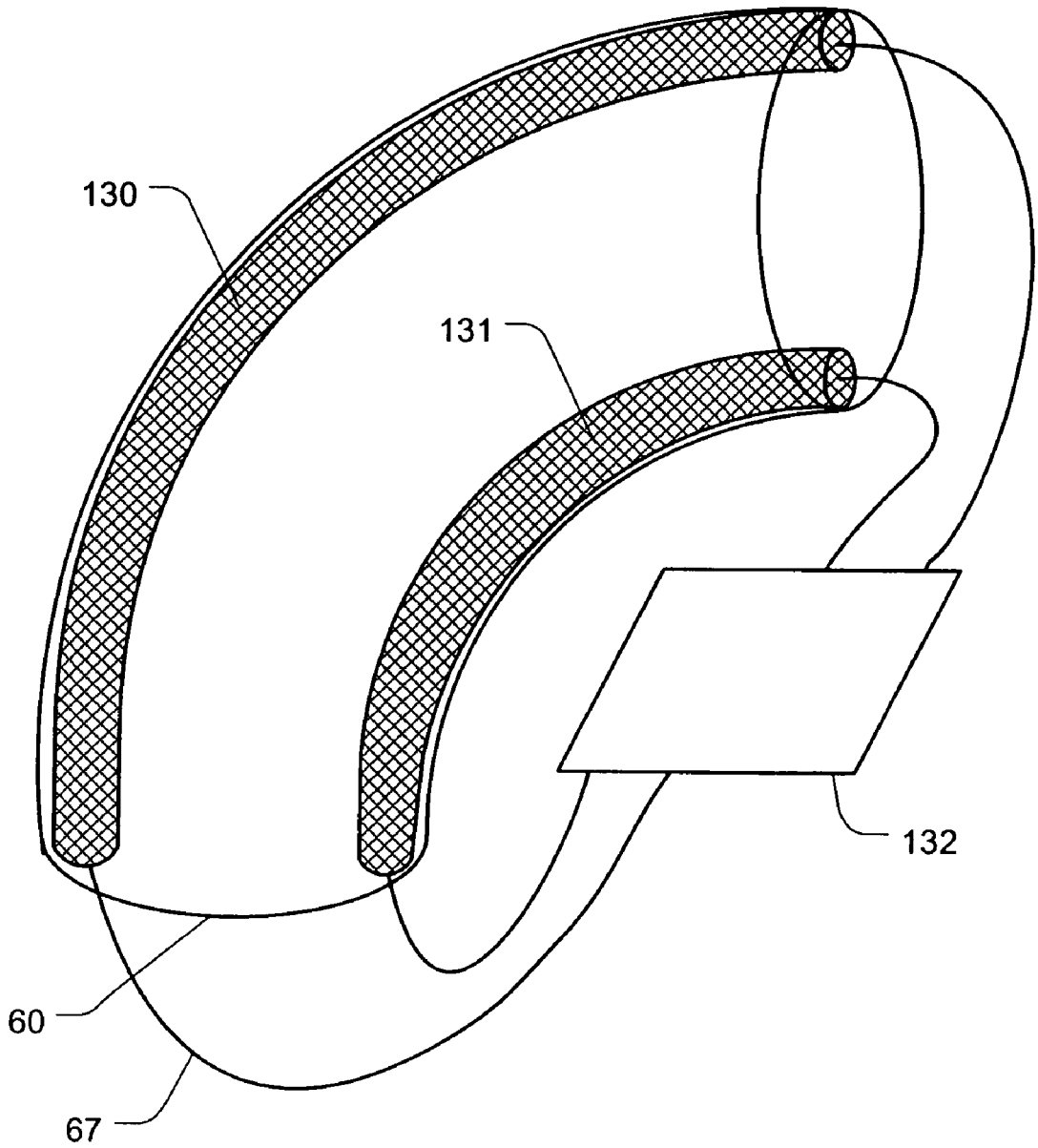
FIG. 13 shows a rope with two indicator threads on opposite sides of a kink in the rope. Their differential elongation allows the sensing device to measure curvature in the rope.

For many rope applications it is useful to know if a rope is kinked. As shown in FIG. 13, this can be detected by running two indicator threads 130 & 131 down opposite sides of the outer surface of the rope 60. If the rope 60 is kinked, the indicator thread on the outside of the kink 130 will be highly strained, while the indicator threads on the inside of the kink 131 will be relaxed. The test equipment to measure differential elongation 132 can then monitor the difference in strain between the indicator threads 130 & 131. If the rope 60 is strained linearly (pulled in a straight direction) then both indicator threads 130 & 131 will increase in resistance equally, but if the rope 60 is kinked then the indicator threads 130 & 131 will change resistance relative to each other. Typically, one would use at least three indicator threads in order to detect curvature in any axis. For improved accuracy and redundancy more than three indicator threads can be used.

Interface—Integrated

A small microcontroller and battery can be integrated directly into the end of the rope to read out the status of the indicator threads. The microcontroller can be turned on by pressing or squeezing an actuator which is on or within the rope and the data can be displayed to a small LCD or LED display, a patch of electrochromic material or via an audio transducer. This would be useful for climbing ropes or other applications where one wants to periodically check the status of the rope, but not necessarily in real time.

Interface—External

For applications with many different ropes that need to be periodically inspected a small portable readout device could be built that would have a microcontroller with rechargeable battery and a more sophisticated display. The device would clamp onto the rope at a region where the indicator threads are on the surface of the rope and accessible to the device. The data from the indicator threads can be read out in real-time, logged, and alarms can be programmed to go off if measured characteristics of indicator threads in the rope fall outside an acceptable range.

Interface—Wireless

Figure 20:
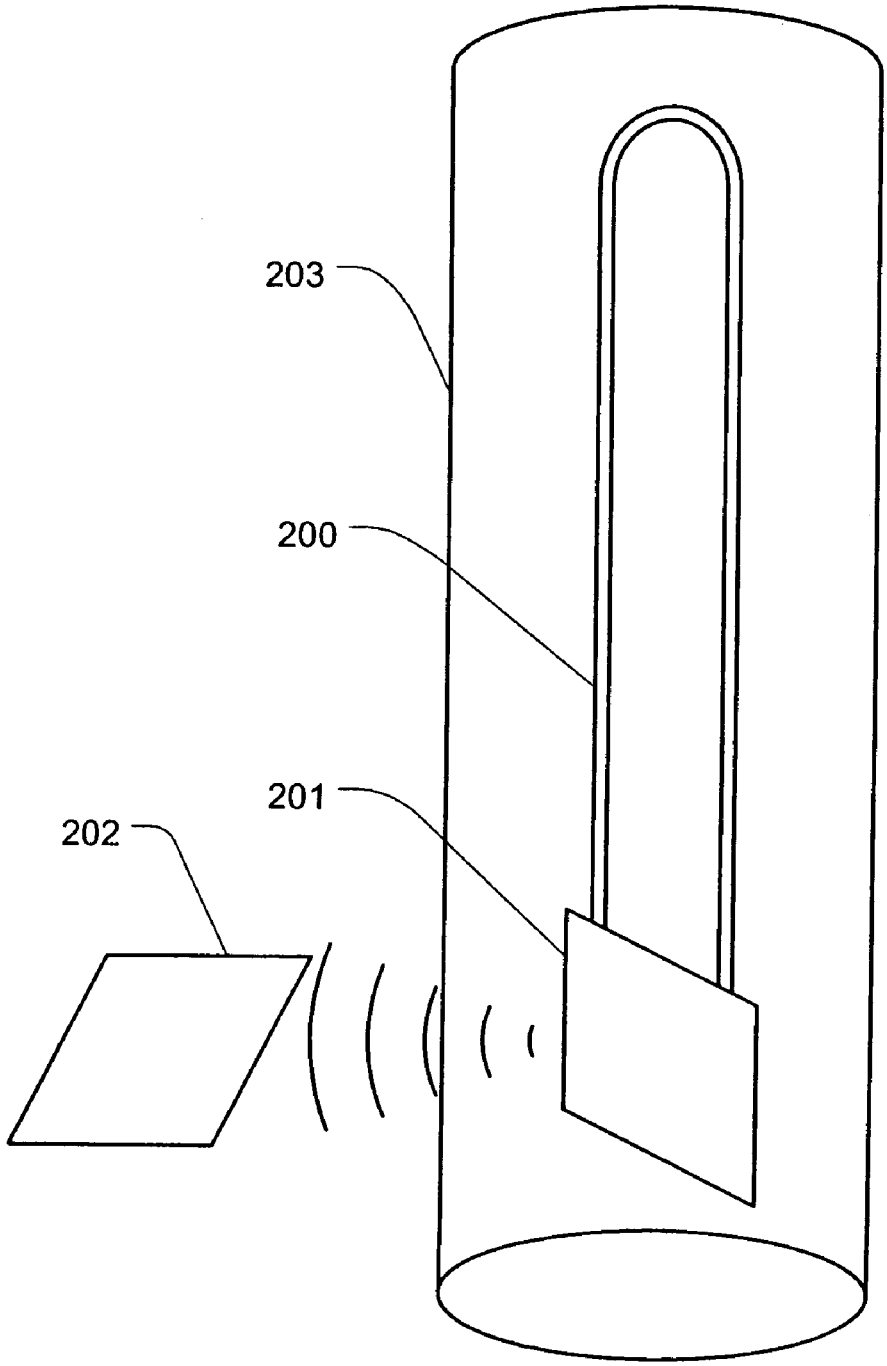
FIG. 20 shows a rope with indicator thread and an embedded sensor which wirelessly transmits elongation data to an external receiver.

For larger more permanent ropes, as shown in FIG. 20, a sensing-processing device 201 can be integrated into the rope 203, coupled to the indicator fiber 200, and powered by a long lifetime battery or wired to a power source. The sensing-processing device 201 could communicate its data in real-time over a wireless network such as bluetooth or 802.11. The data from many different ropes could all be collected by a central server 202, analyzed, and presented to the user.

Tap Points Along

Figure 14:
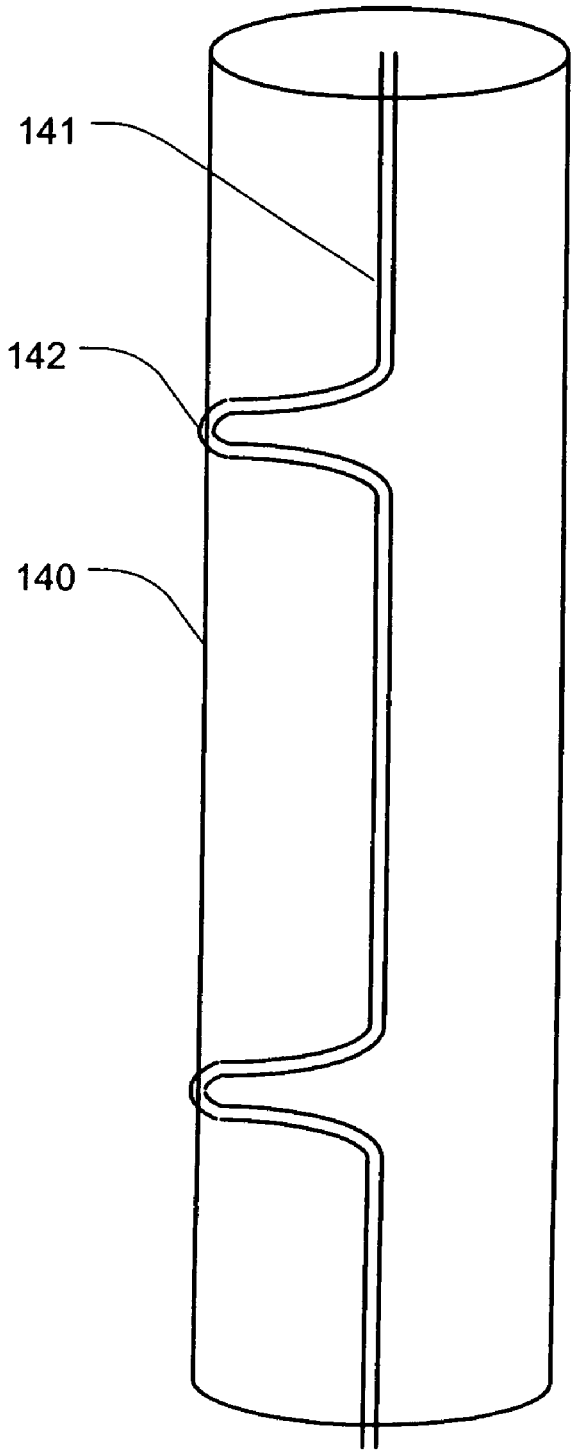
FIG. 14 shows an indicator thread with multiple direct-connect tap points along its length.

If the rope incorporates several indicator threads it may be necessary to make electrical connections to each of the individual indicator threads to read out the data. As shown in FIG. 14, one way to do this is to run each of the indicator threads 141 on the inside of the rope 140 and then periodically bring each indicator thread to the outside of the rope 140 as a tap point 142 for a short length of the rope. These tap points 142 may be color-coded so that they are easy to identify and make connections to.

Figure 12:
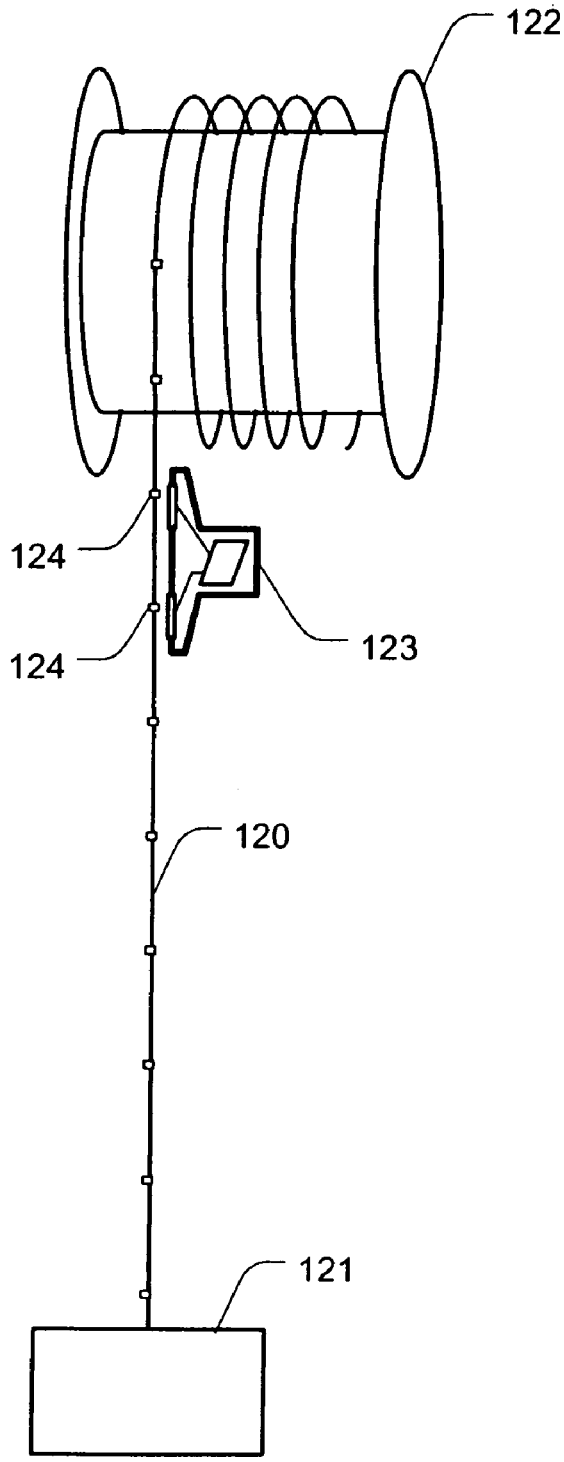
FIG. 12 shows a situation where, due to winching, one might want to measure the elongation of a rope in just a section of the rope.
Figure 17:
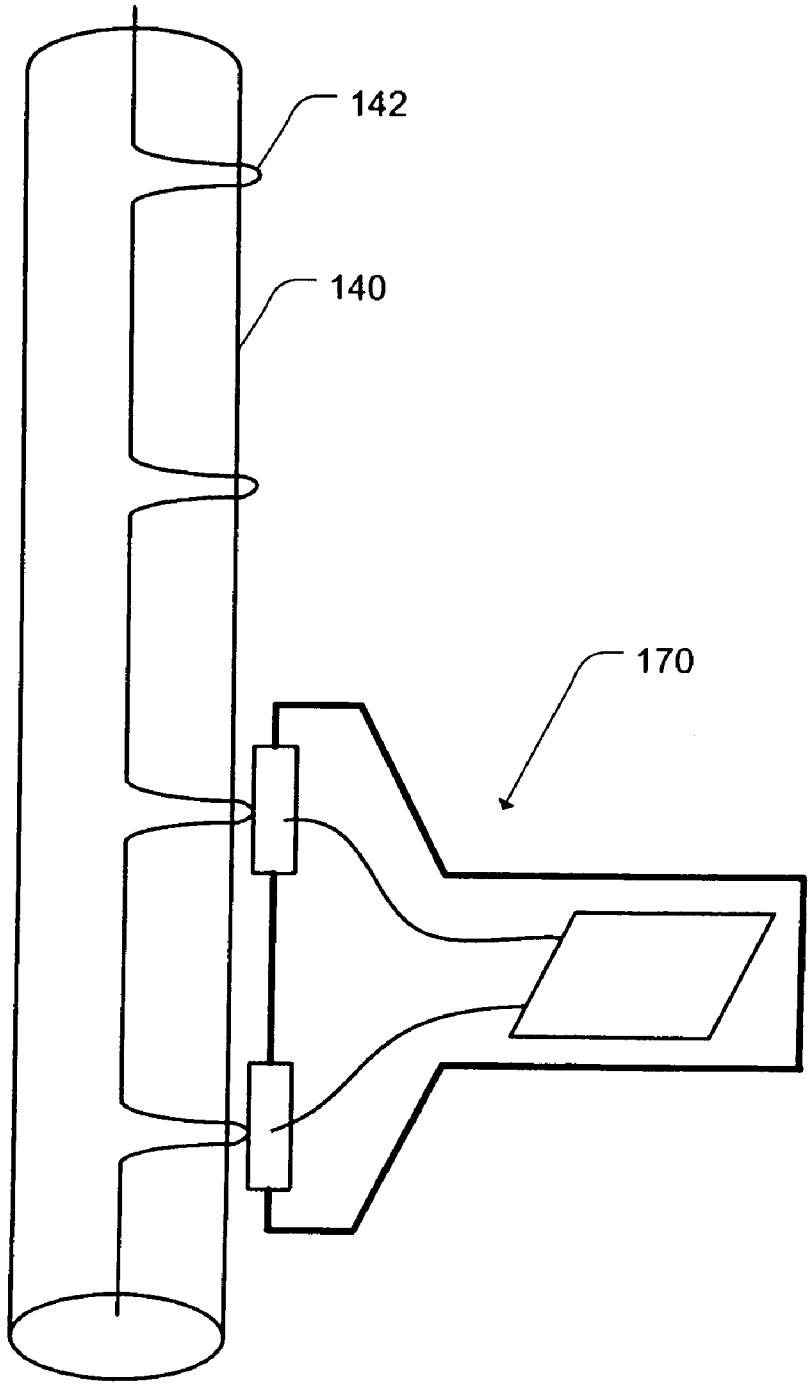
FIG. 17 shows an indicator thread with multiple direct-connect tap points along its length connected to a sensing device.

As shown in FIG. 17, the user attaches a sensing device 170 to the outside of the rope 140 and it can make a direct electrical connection to two adjacent tap points 142. This is useful as shown in FIG. 12, where a sensed rope 120 with tap points 124 along its length is being winched onto a spool 122. The elongation of the rope 120 on the spool 122 may not be the same as the elongation of the rope 120 off the spool 122 and close to the load 121 hanging from the rope 120. A test equipment 123 is shown making direct connection to adjacent tap points 124 on the rope 120 allowing elongation in that section of the rope 120 to be measured.

Figure 15:
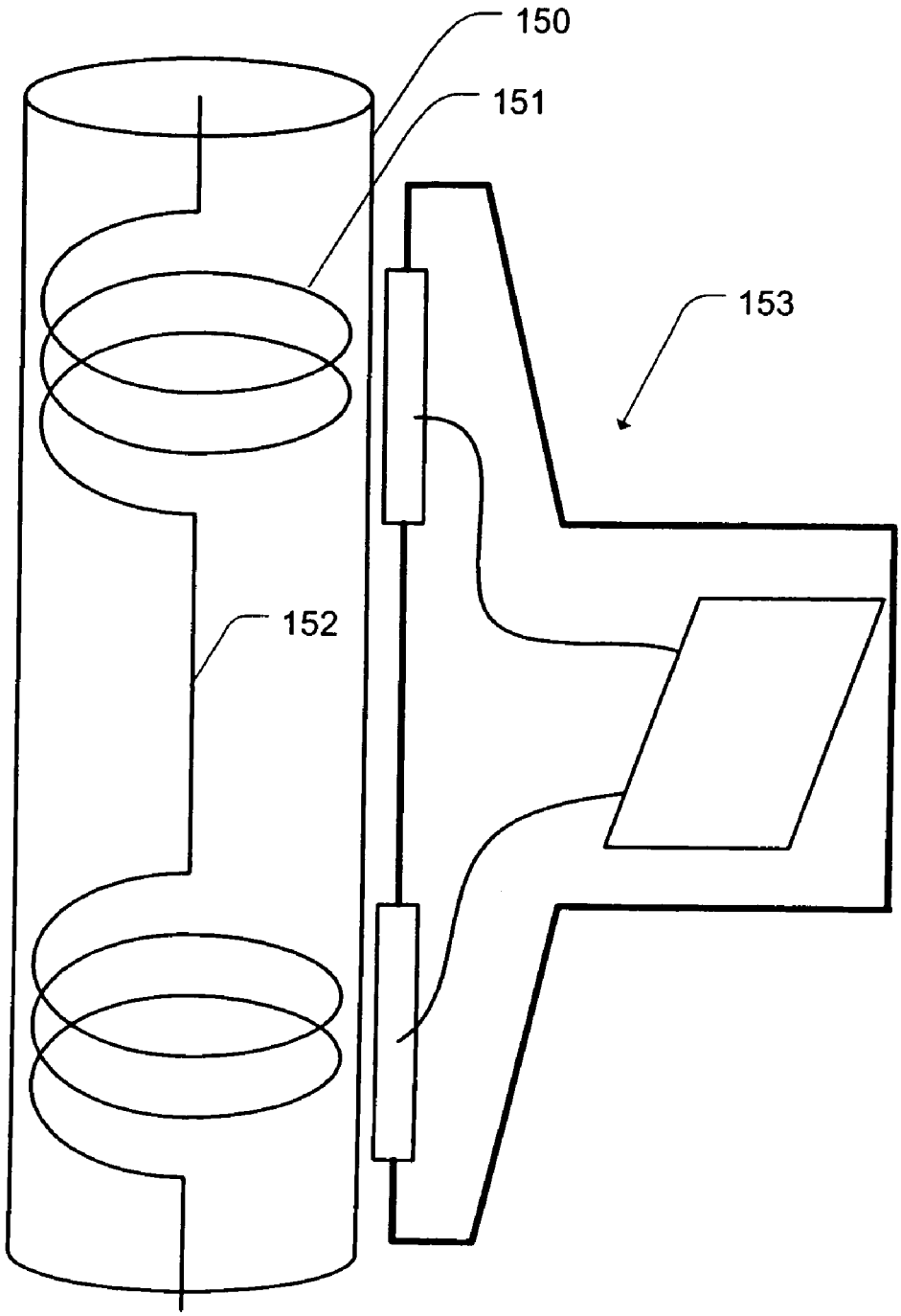
FIG. 15 shows a rope with an indicator fiber with periodic whipped sections allowing a sensing device to inductively couple to the indicator thread at these inductive tap points.

Alternatively, as shown in FIG. 15, the indicator bundle 150 may have periodic sections where the indicator thread is highly whipped 151 interleaved with sections where the indicator thread is less whipped 152. A test equipment 153 may be inductively coupled to this pair of inductive tap points 151. Note that although the test equipment 153 is shown coupling to the indicator bundle 150 from one side, effectively coupling to the whipped sections of the indicator thread 151 is likely to require the test equipment to encircle the indicator bundle 150.

Conductive tap-points can be constructed during or after the braiding process by causing an indicator thread from the core to be brought to the sheath and then returned to the core over a short length span. Tap-points could also be created by adding an extra conductive element to the rope during or after the braiding process which connects the desired indicator thread to the outside of the rope.

Herein, the term "tap point" refers to sections of a fibrous tension member providing electrical connectivity to an external sensing-processing unit by means of direct electrical contact or coupling to an electromagnetic field.

Tap Points Around

Figure 16A:
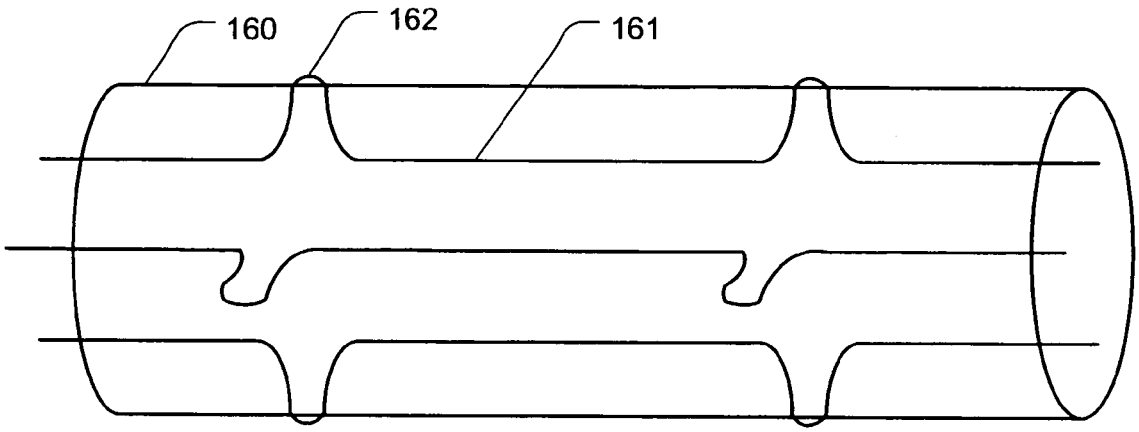
FIG. 16*a* shows a rope with three indicator threads each with direct-connect tap points staggered both along and around the periphery of the rope.
Figure 16B:
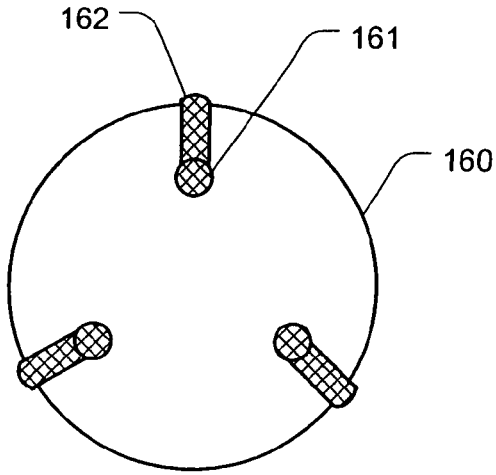
FIG. 16*b* shows the same rope in section.
Figure 18:
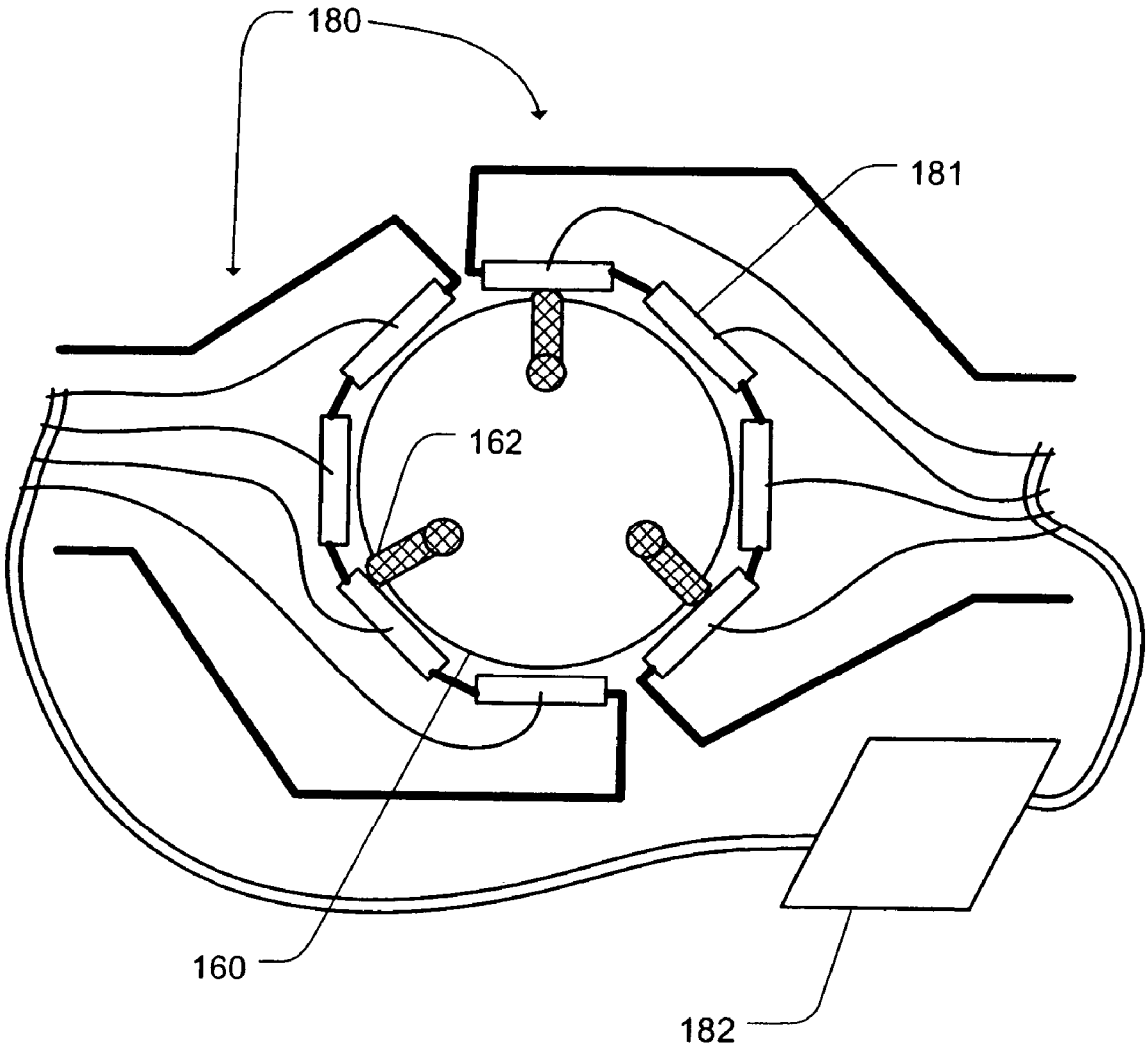
FIG. 18 shows a rope with three indicator threads each with direct-connect tap points staggered around the periphery of the rope connected to a sensing device.

Alternatively, as shown in FIGS. 16*a* (the rope shown along its length) & 16*b* (the rope shown in axial section at a tap point junction), all the indicator threads may travel in the core 161 for some length of the rope 160 and then emerge to the periphery of the rope 160 as a set of tap points 162 spaced periodically around its circumference. As shown in FIG. 18, a ring connector 180 composed of periodically spaced connector terminals 181 could be attached around the rope 160 to simultaneously connect all the tap points to the test equipment 182. In order to distinguish between the indicator threads, the tap points may be arranged with a non-symmetry such as by omitting one indicator thread. This would key the rope and allow the test equipment to identify which indicator thread is which.

Figure 19:
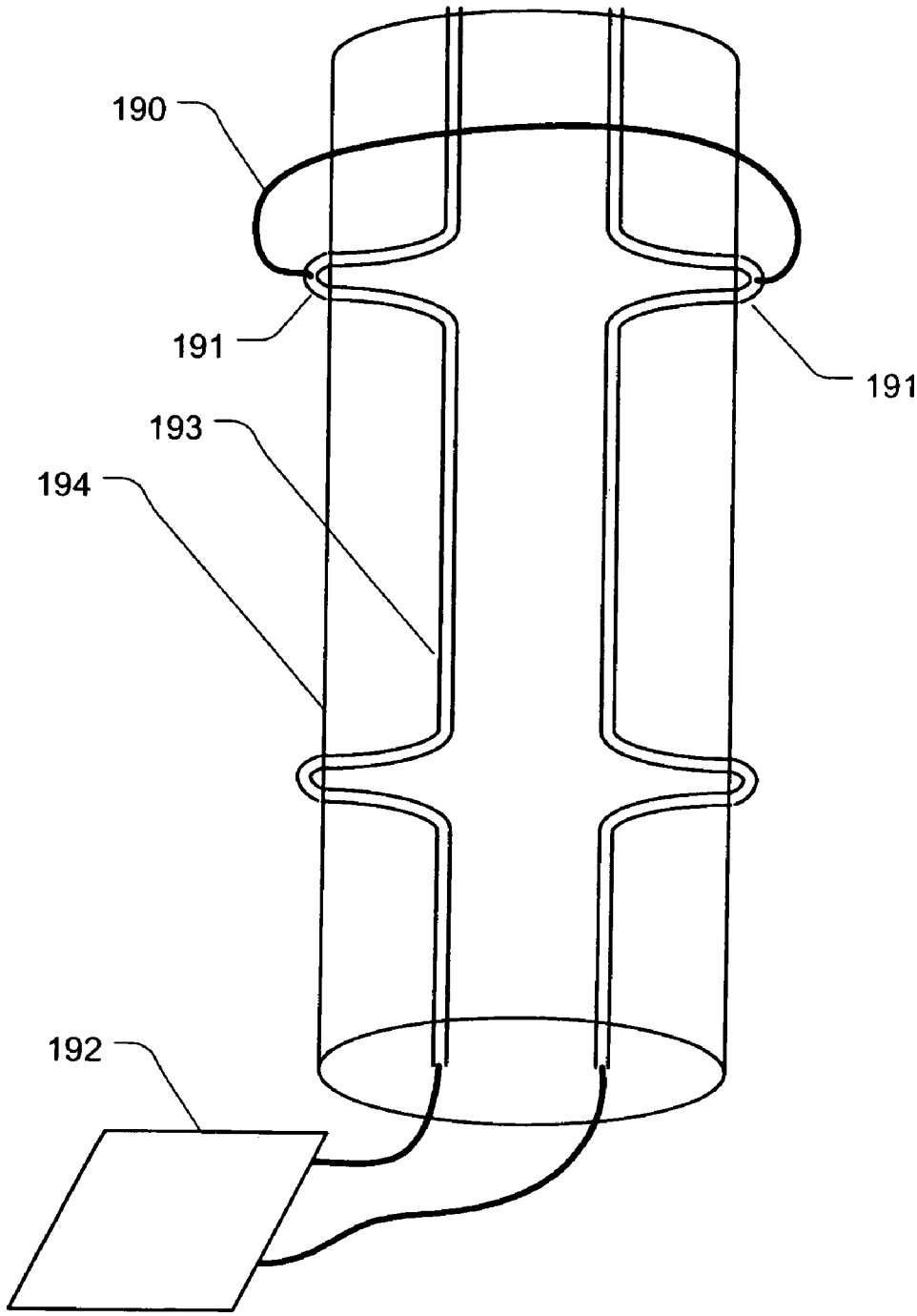
FIG. 19 shows rope with two indicator fibers, a sensing device attached to one, and an external splice allowing the sensing device to measure characteristics of the rope section between the sensed endpoint and the splice.

As shown in FIG. 19, a jumper 190 may be applied to a pair (or more) of tap points 191. This allows the test equipment 192 to sense the indicator threads 193 between the end of the rope 194 and the jumpered 190 tap points 191. This is an easy non-permanent way to make a loop. It allows making a loop at any pair of tap points using a simple clamp-on device.

Whipped—Inductively Measured

Figure 2:
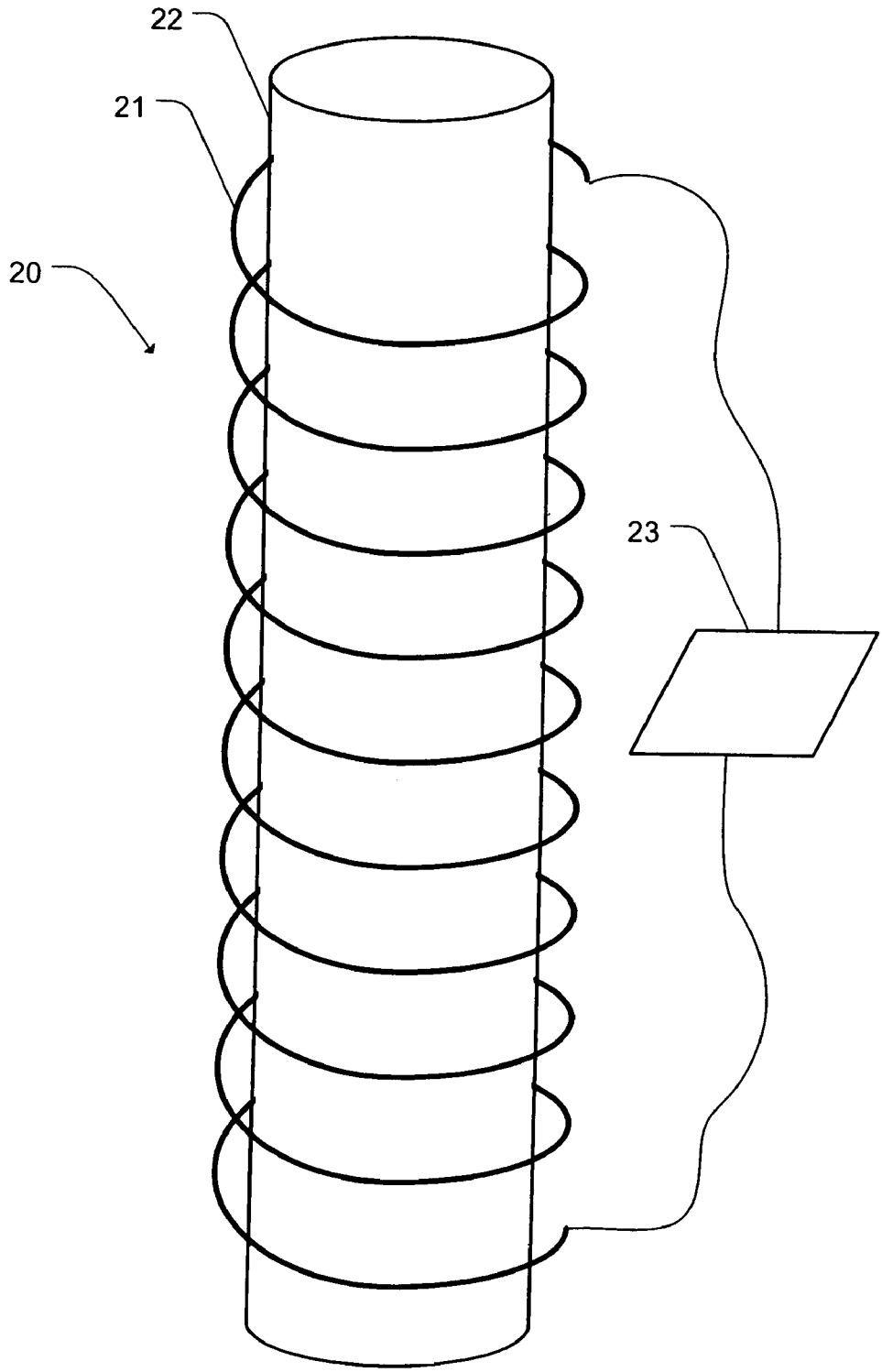
FIG. 2 shows an indicator thread comprising a whipped insulated conductive fiber.

FIG. 6 shows the indicator threads 62 oriented substantially parallel to the rope 60 axis. The shown indicator thread 62 may be replaced with an indicator bundle 20 as shown in FIG. 2. Here, the indicator bundle 20 consists of an indicator thread 21 "whipped" (i.e. helically-wrapped) around a core 22, forming a coil. The indicator thread 21 may be bare or insulated and is composed of discrete segments of conductive fibers. The core 22 may be conductive or non-conductive.

Voltage along a whipped indicator thread 21 is proportional to rate of change of current supplied by the test equipment 23 and the coil's 21 coefficient of self inductance. Said coefficient is a purely geometric quantity, having to do with the sizes, shapes, and relative orientations of the loops of the indicator thread 21. As the helix is strained axially, the mutual inductance of the loops decreases as does the measured inductance of the indicator thread 21.

As shown in FIG. 1, the indicator bundle 10 may employ a bare indicator thread 11 helically-wrapped around a core 12 where adjacent coils of the indicator thread 11 are insulated from each other by interlacing a whipped non-conductive thread 13.

Whipped—Inductive Coupling to Sensor

Figure 3:
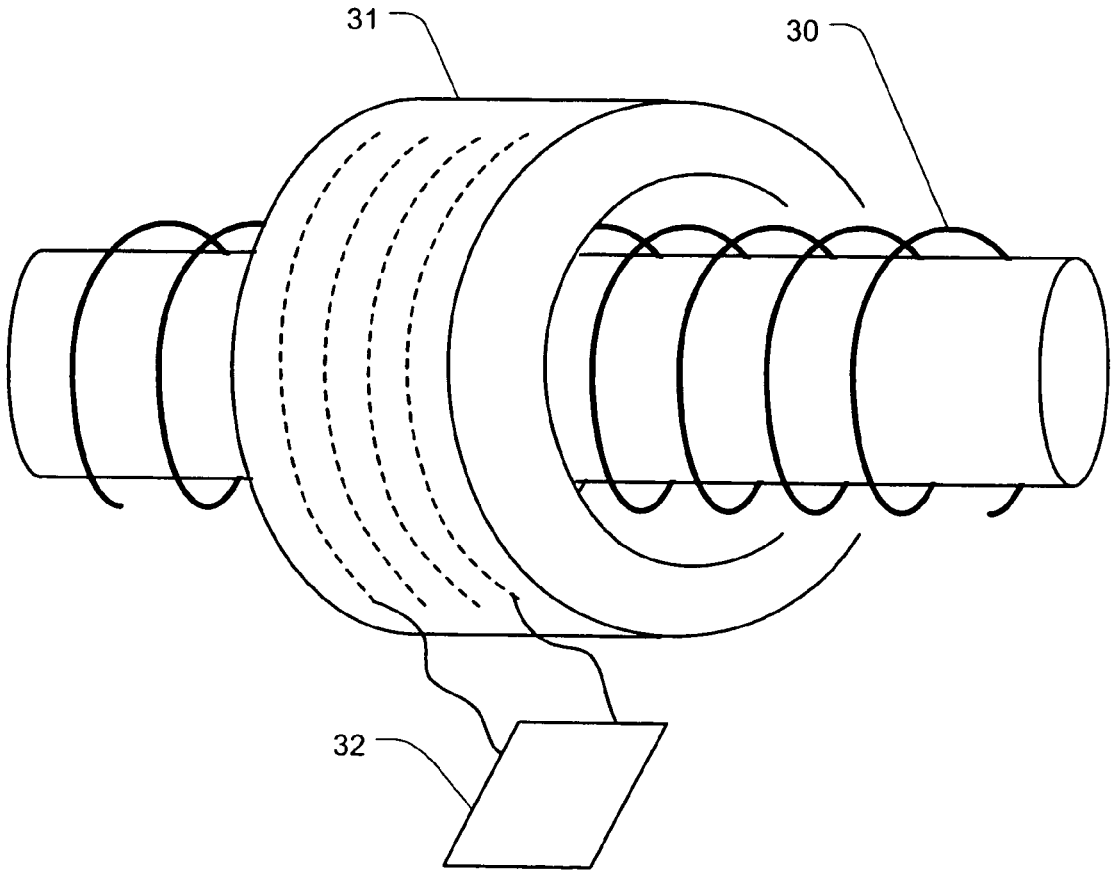
FIG. 3 shows an indicator thread comprising a whipped conductive fiber with an inductively coupled sensor attached to outside of rope.

As shown in FIG. 3, voltage may be induced in a whipped indicator thread 30 by the electromagnetic interaction with an inductive sensing device 31. The induced voltage is a function of the mutual inductance between the whipped indicator thread 30 and the inductive pickup 31 which is itself connected to a test equipment 32. The mutual inductance is in part a function of the whipped indicator's size, shape and orientation of coil loops. As the whipped indicator's helix is elongated axially, the mutual inductance decreases.

Coax

Figure 5:
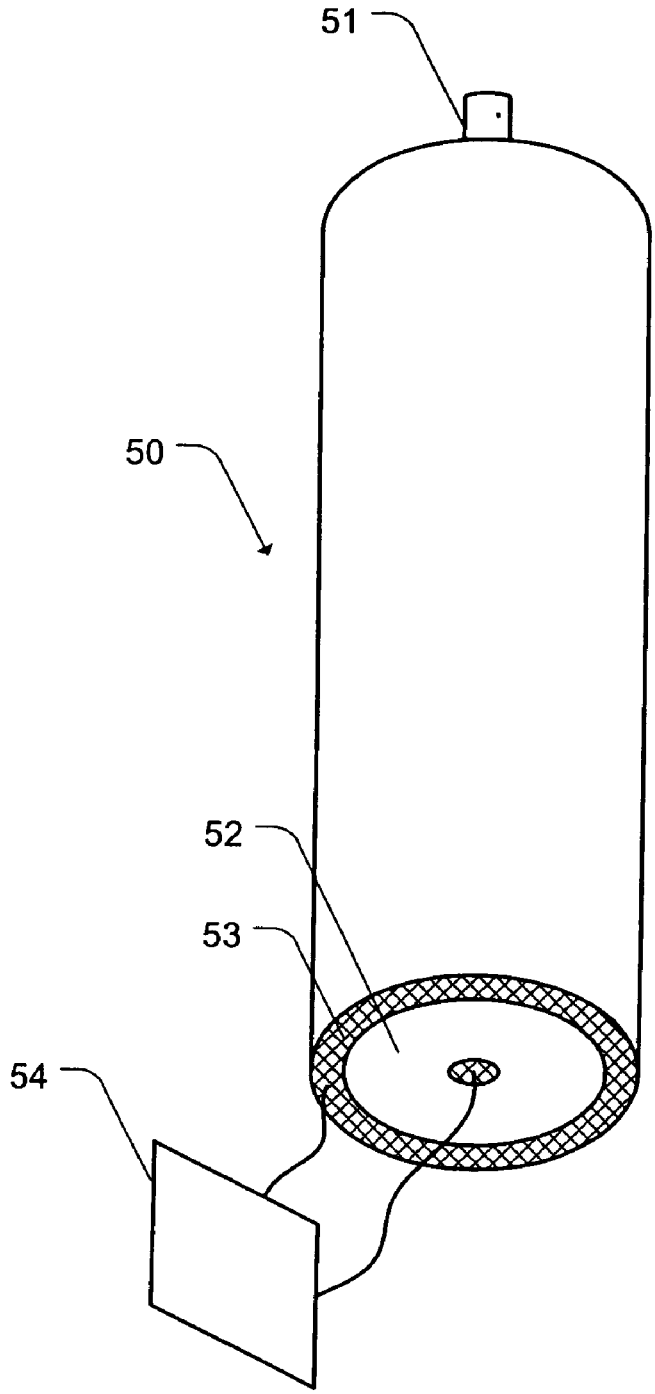
FIG. 5 shows an indicator thread comprising a coaxial indicator thread connected to a sensing device.

As shown in FIG. 5, the indicator bundle 50 may be configured as a coaxial cable. An indicator thread 51 (which is itself composed of discrete conductive fibers as in FIG. 6), is sheathed in insulation 52 which is itself surrounded by a conductive sheathe 53. This conductive sheathe 53 may be a sheet material, continuous conductive fibers running parallel to the bundle axis, woven S- and Z-oriented wires as typically used in coaxial cable construction, or a whipped thread (as shown in FIG. 2). A connected test equipment 54 measures capacitance or transmission line properties via standard means such as time domain reflectrometry (TDR), frequency domain reflectometry (FDR) or spectrum analysis. Some test methods may require an electrical termination device to be connected from the indicator thread 51 to the conductive sheath 53 at the end of the coaxial cable.

Preforming and Prestressing

Depending on the fibrous tension member fabrication and elongation sensing methods, the indicator threads may be preformed to reduce or eliminate residual stresses which are created during the yarn making process. Preforming is the process of twisting an elongated member, such as a filament (or the like) in the opposite direction as the twisting process to make a cord, yarn, strand so that the elongated member is relatively untwisted in the manufactured cord, yarn, or strand.

Sampling Rate

Loads may be applied to the fibrous tension member axially, radially, torsionally, or in combination. Indicator threads may be incorporated into the fibrous tension member in appropriate number and position to optimally measure desired information of expected loads. Loads may be static, random, or periodic with respect to time. If it is desired to characterize random or periodic loads, the Nyquist criterion will determine sampling rate requirements. This criterion states that if a waveform is to be reconstructed after sampling, that waveform must be sampled at twice the fundamental frequency.

Indicator Thread with Changing Resistance

Figure 8:
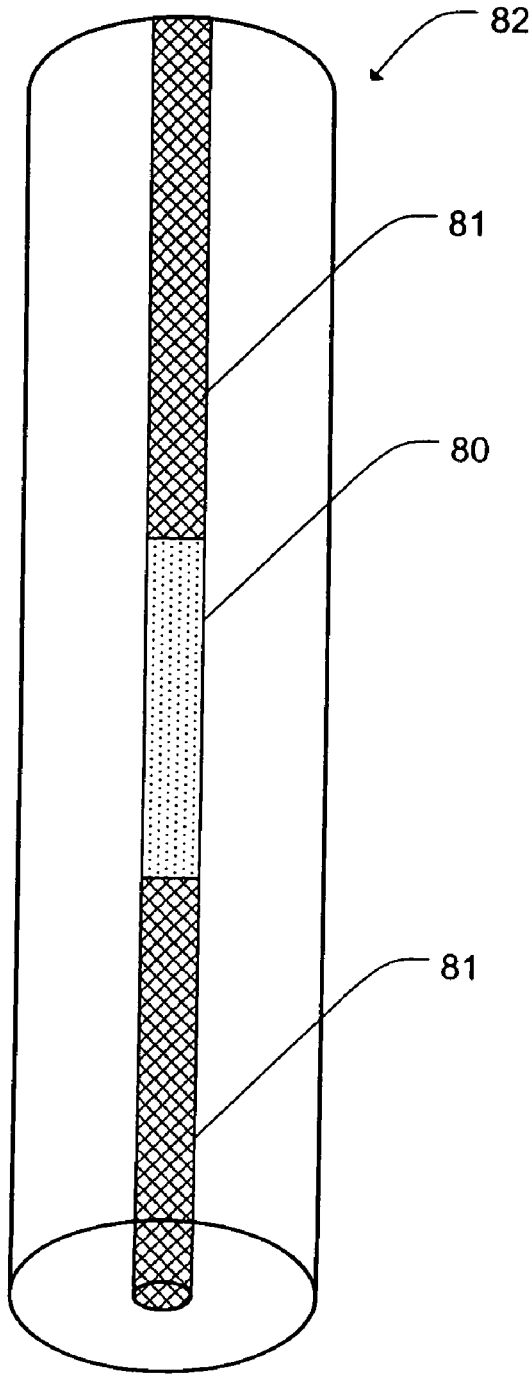
FIG. 8 shows an indicator thread which changes in conductivity along its length.

As shown in FIG. 8, a resistance-sensed conductive indicator thread 80 & 81 (of the type shown in FIG. 6) incorporated into a rope 82 may change in conductivity along its length. For example, the indicator thread may have a section with high resistance per unit length 80 surrounded by sections with low resistance per unit length 81.

Indicator Thread with Changing Capacitance

Figure 9:
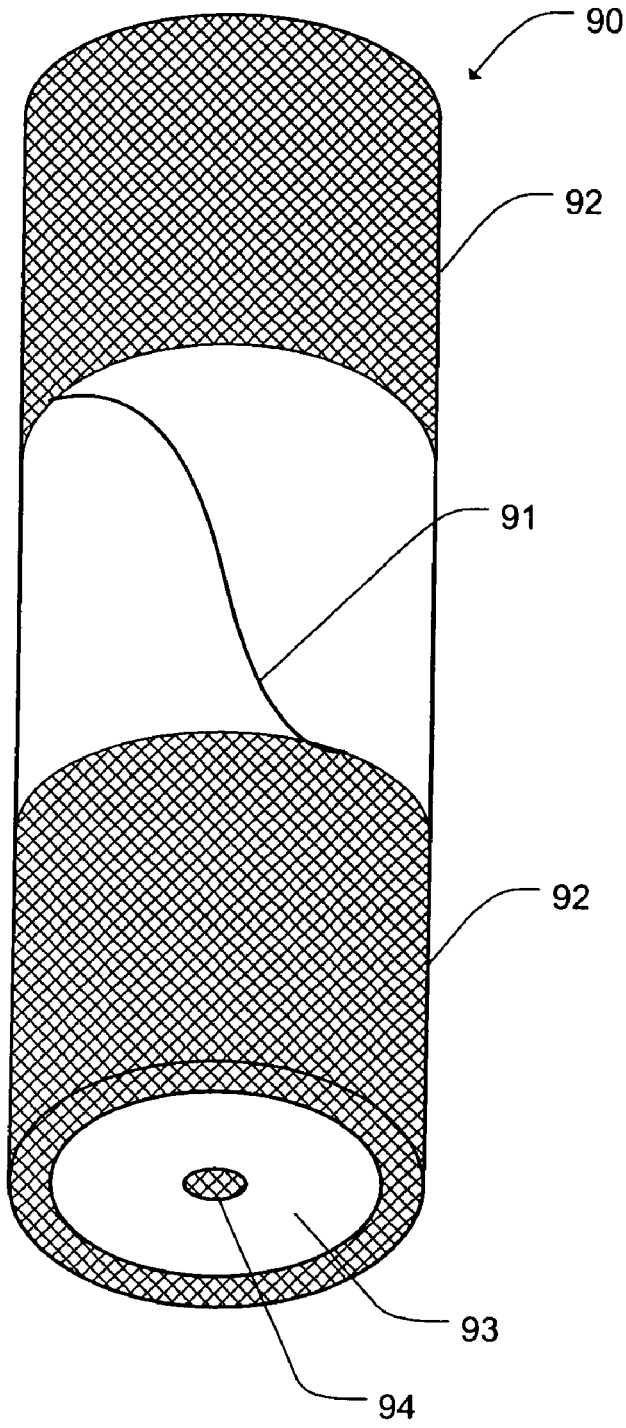
FIG. 9 shows a coaxial indicator thread which changes in capacitance along its length.

As shown in FIG. 9, a capacitance-sensed conductive indicator bundle 90 incorporated into a rope may change in capacitance along its length. For example, the indicator bundle may have a section with low capacitance per unit length 91 surrounded by sections with high capacitance per unit length 92. Capacitance per unit length is a function of the area and distance between the conductive core 94 and the conductive sheathe 92. Capacitance per unit length is also a function of the dielectric 93 insulating these two electrodes.

Indicator Thread with Changing Inductance

Figure 10:
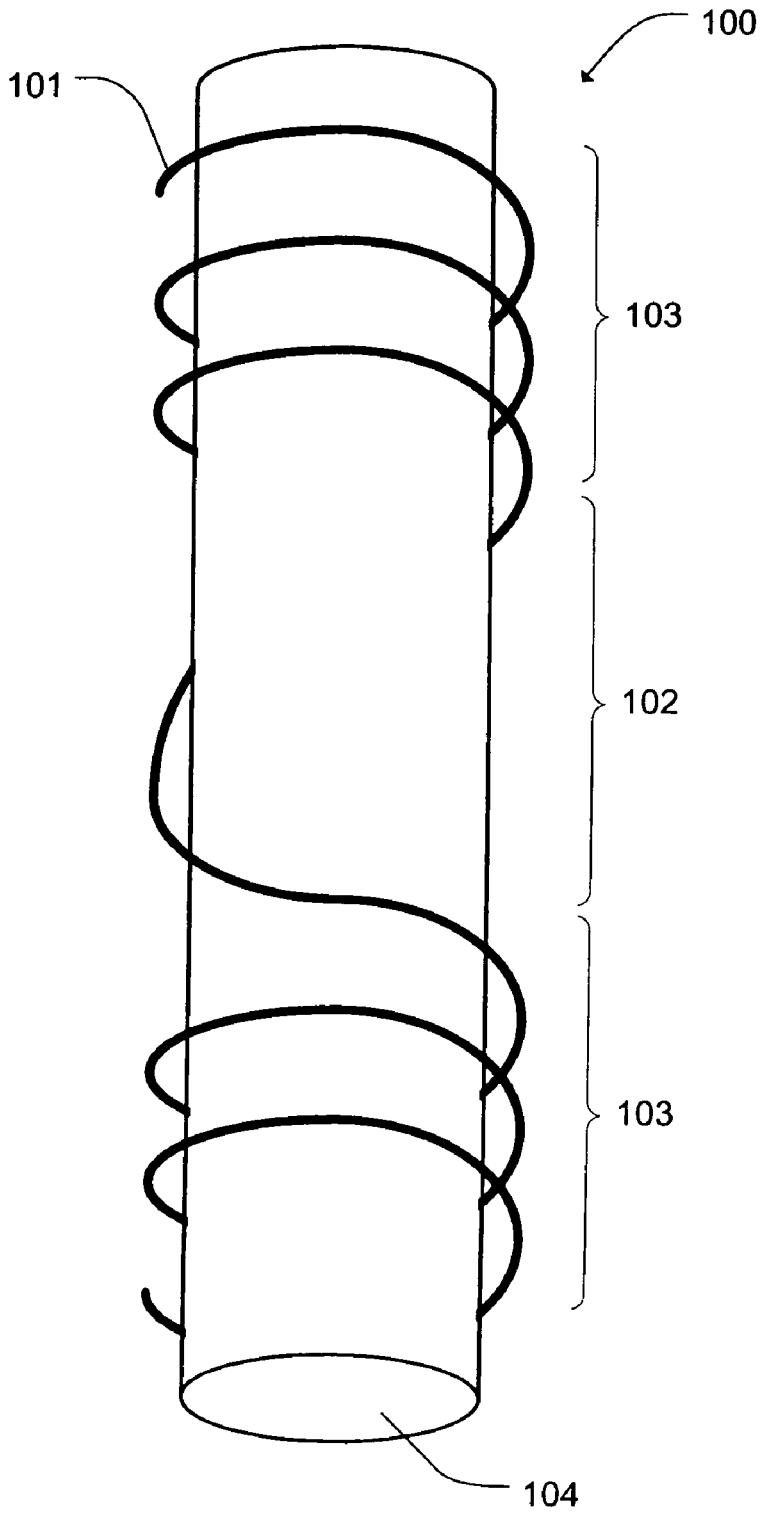
FIG. 10 shows a coaxial indicator thread which changes in inductance along its length.

As shown in FIG. 10, an inductance-sensed indicator bundle 100 incorporated into a rope may change in inductance along its length. In this example, the indicator thread 101 is helically wrapped with changing pitch around a non-conductive core 104. The indicator bundle 100 has a section with low inductance per unit length 102 surrounded by sections with high inductance per unit length 103. This configuration is more sensitive to elongation in the tightly coiled areas 103. The change in inductance per length due to elongation of the loosely coiled section 102 is less than that of the tightly coiled section 103.

Independently Measuring Elongation in Multiple Rope Segments

Figure 11:
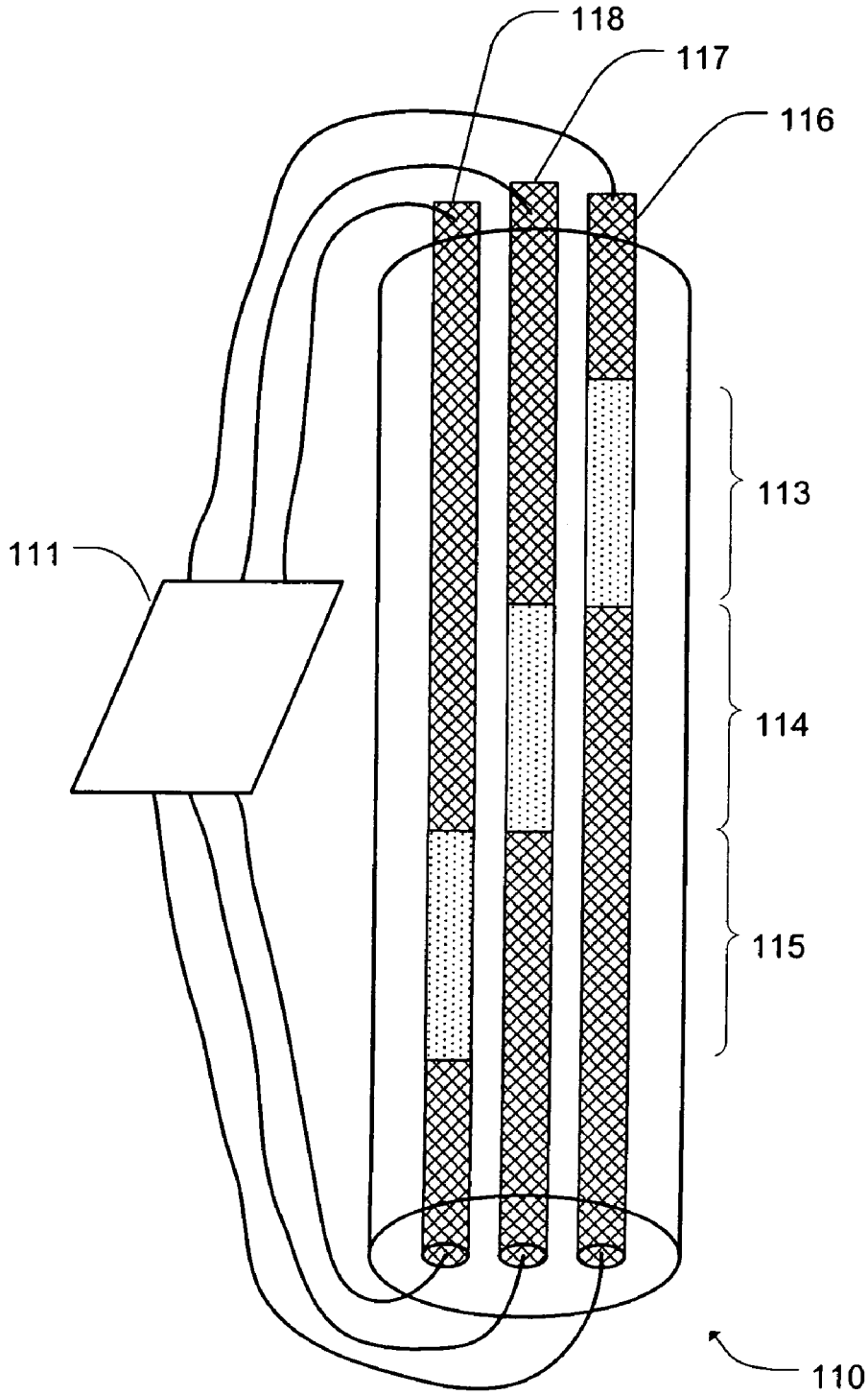
FIG. 11 shows a rope with multiple indicator threads configured to allow sensing device to locate which region of the rope is experiencing the sensed elongation.

FIG. 11 shows how a rope 110 with three indicator threads 116, 117, 118 are used to measure elongation in three different regions 113, 114, 115, respectively, of the rope 110. This could be useful if elongation is non-uniform along the length of the rope 110 and the application requires understanding the elongation gradient along the rope 110. Alternatively, in the case of winching a rope onto a spool, the length of rope 110 subject to the stress of a load changes as more or less rope 110 is played out off the spool. This requires that the measured characteristics of the rope 110 are calibrated against the length of rope 110 experiencing that load. FIG. 11 shows how a rope 110 can deliver elongation data for sections of rope 113, 114, 115 to test equipment 111 where each section has identical length. Indicator thread 116 has lower conductivity in region 113 and higher conductivity in regions 114 and 115. This makes it more sensitive to elongation in region 113. Similarly, indicator thread 117 has lower conductivity in region 114 and higher conductivity in regions 113 and 115. This makes it more sensitive to elongation in region 114.

In general, "N" separate indicator threads will provide "N" independent elongation measurements using resistive measurement. Capacitive or inductive-sensed indicator threads/bundles can be used instead of the shown resistive-sensed indicator threads 116, 117, 118. Indicator bundles sensed with transmission line analysis can provide richer information about elongation along the thread.

From the foregoing detailed description, it can be appreciated that the illustrated fibrous tension members provide a new 'intelligent textile' product category that enables fibrous tension members to signal their own elongation electronically to a sensing-processing unit which may be external or incorporated into the fibrous tension member. The present invention uses electrical indicator threads to measure elongation rather than simple breaks. The present invention also allows the sensing device to connect to the fibrous tension member at a variety of locations along the fibrous tension member. When desired, the present invention further allows the sensing device to measure elongation for a region of the fibrous tension member instead of along the entire length of the fibrous tension member.

From the foregoing detailed description, it can also be appreciated that the illustrated fibrous tension members provide the following advantages:

1. Overall or localized electronic sensing of elongation in fibrous tension members;

2. Overall or localized electronic sensing of curvature such as kinks in fibrous tension members;

3. Overall or localized self-heating of fibrous tension members for cold climate applications;

4. Convenient interface between fibrous tension member and sensing-processing device by means of direct connection tap points around periphery or along length of fibrous tension member;

5. Convenient interface between fibrous tension member and sensing-processing device by means of non-contact inductive coupling; and 6. Incorporation of sensing-processing device into the fibrous tension member to ensure that all elongations are recorded and means to communicate acquired data via direct connection or wirelessly.

As an example of the potential use for this technology, consider recreational climbing ropes which are rated to be used up to a yield strain. The addition of an intelligent sensor would remove the risk and uncertainty of trying to estimate how much a rope has been strained. In addition, many ropes are supposed to be retired after they have strained past a certain critical point a certain number of times. An intelligent system could monitor and keep track of how many times the rope has been critically strained.

As an additional example, electric cables such as high tension power lines: these could be enhanced by adding a thin intelligent rope sheathing around the outside of the cable. This intelligent rope material could inform the power company when it is under unusual tension, such as when a tree branch falls on the cable. This would allow the cable owners to perform preventative maintenance on the cable, thus averting outages.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A method for sensing curvature, comprising:

providing a fibrous tension member a plurality of structural threads; and providing a fibrous tension member two or more indicator threads, wherein the two or more indicator threads are located with respect to the plurality of structural threads such that a differential elongation between the two or more indicator threads indicates a curvature, and wherein the differential elongation between the two or more indicator threads is measured using a change in one or more electrical properties of each of the two or more indicator threads as each of the two or more indicator threads changes in length; and electrically connecting a sensing-processing device to the two or more indicator threads to determine a curvature of the fibrous tension member.

2. A system for sensing curvature, comprising:

a fibrous tension member comprising a plurality of structural threads; and a fibrous tension member comprising two or more indicator threads, wherein the two or more indicator threads are located with respect to the plurality of structural threads such that a differential elongation between the two or more indicator threads indicates a curvature, and wherein the differential elongation between the two or more indicator threads is measured using a change in one or more electrical properties of each of the two or more indicator threads as each of the two or more indicator threads changes in length; and a sensing-processing device, wherein the sensing-processing device is electrically connected to the two or more indicator threads to determine a curvature of the fibrous tension member.

3. A system for sensing curvature as in claim 2, wherein one of the one or more electrical properties comprises a resistance of one of the two or more indicator threads.

4. A system for sensing curvature as in claim 2, wherein one of the one or more electrical properties comprises a capacitance of one of the two or more indicator threads.

5. A system for sensing curvature as in claim 2, wherein one of the one or more electrical properties comprises an inductance of one of the two or more indicator threads.

6. A system for sensing curvature as in claim 2, wherein the two or more indicator threads are located on the outer surface of the rope.

7. A system for sensing curvature as in claim 2, wherein the two or more indicator threads are located on opposite sides of the outer surface of the rope.

8. A system for sensing curvature as in claim 2, wherein the two or more indicator threads are located on the outer surface of the rope such that curvature in any axis can be detected.

9. A method for sensing curvature as in claim 1, wherein one of the one or more electrical properties comprises a resistance of one of the two or more indicator threads.

10. A method for sensing curvature as in claim 1, wherein one of the one or more electrical properties comprises a capacitance of one of the two or more indicator threads.

11. A method for sensing curvature as in claim 1, wherein one of the one or more electrical properties comprises an inductance of one of the two or more indicator threads.

12. A method for sensing curvature as in claim 1, wherein the two or more indicator threads are located on the outer surface of the rope.

13. A method for sensing curvature as in claim 1, wherein the two or more indicator threads are located on opposite sides of the outer surface of the rope.

14. A method for sensing curvature as in claim 1, wherein the two or more indicator threads are located on the outer surface of the rope such that curvature in any axis can be detected.

* * * * *